US006651344B2

(12) United States Patent
Cheng

(10) Patent No.: US 6,651,344 B2
(45) Date of Patent: Nov. 25, 2003

(54) FOLDABLE KNIFE STRUCTURE

(75) Inventor: Yang-Fu Cheng, Taipei (TW)

(73) Assignee: Kantas Products Co., Ltd., Taipei (TW)

( * ) Notice: Subject to any disclaimer, the term of this patent is extended or adjusted under 35 U.S.C. 154(b) by 76 days.

(21) Appl. No.: 10/119,053

(22) Filed: Apr. 10, 2002

(65) Prior Publication Data

US 2003/0140500 A1 Jul. 31, 2003

(30) Foreign Application Priority Data

Jan. 31, 2002 (TW) ..... 91201065 U

(51) Int. Cl.[7] ..... B26B 1/04; B26B 1/06
(52) U.S. Cl. ..... 30/159; 30/160
(58) Field of Search ..... 30/159–161, 158, 30/155

(56) References Cited

U.S. PATENT DOCUMENTS 2,098,678 A * 11/1937 Schrade ..... 30/159
6,145,202 A * 11/2000 Onion ..... 30/160
6,308,420 B1 * 10/2001 Moser ..... 30/161
6,397,476 B1 * 6/2002 Onion ..... 30/160

* cited by examiner

*Primary Examiner*—Douglas D. Watts
(74) *Attorney, Agent, or Firm*—Bacon & Thomas, PLLC

(57) ABSTRACT

The present invention relates to a foldable knife structure, which comprises a handle; a blade pivotably conjoined to a position adjacent to one end of the said handle; a set block adjacent to the pivotable conjoinment position of the blade and the said handle, with the said set block having a detent notch; a spring situated at the other end of the said handle, with the opposite extremity of the said spring extending to a position on the said set block. When the said blade is extended from (or folded into) the said handle, the said spring is against the circumferential edge of the said set block, causing the said set block to produce torsion that rotates the said blade out of (or into) a receiving slot of the said handle, causing the said blade to automatically bound out of (or fold into) the said receiving slot.

9 Claims, 9 Drawing Sheets

FOLDABLE KNIFE STRUCTURE

BACKGROUND OF THE INVENTION

1.) Field of the Invention

The invention herein relates to the field of folding knives and cutlery, more specifically to a foldable knife structure.

2.) Description of the Prior Art

Referring to FIG. 1, a conventional folding knife, such as the Taiwanese Patent "Improved Type Folding Knife" (application number 089210927), typically consists of a handle 1, a blade 2 pivotably conjoined to the front end of the said handle 1 and capable of being rotated into the said handle 1 and, furthermore, an internally disposed safety latch 16 and check block 18, the features of which include:

An actuating mechanism consisting of a locating block 10, a guide wheel 12, and a spring 14 is installed inside the handle 1; the locating block 10 is situated in the handle 1 away from the pivotable conjoinment area of the blade 2, the said guide wheel 12 is movably positioned on the blade 2 adjacent to the pivotable conjoinment area between the blade 2 and the handle 1, and the spring 14 has one extremity in the said locating block 10 and its opposite extremity extends between the pivotable conjoinment area of the blade 2 and of the handle 1 and finally against the said guide wheel 12.

Based on the preceding elaboration and referencing FIG. 1, in the said Taiwanese Patent, the said spring 14 must extend pass the pivotable conjoinment area between the blade 2 and the handle 1; during the rotating process of the said blade 2, the said spring 14 must be maintained in the said state against the guide wheel 12 such that as the said blade 2 is rotated into the said handle 1, the said guide wheel 12 moves from point A along the said check block 18 and when the said guide wheel 12 passes point B of the said check block 18, the elasticity of the said spring 14 impels the said guide wheel 12 along the said check block 18 down to point C of the said check block 18 and, furthermore, rests against the said guide wheel 12, causing the said blade 2 to be fully rotated into the said handle 1; as to rotate the said blade 2 out of the said handle 1, the said guide wheel 12 moves from point C along the said check block 18 such that when the said guide wheel 12 passes point B of the said check block 18, the elasticity of the said spring 14 impels the said guide wheel 12 along the said check block 18 up to point A of the said check block 18, causing the said blade 2 to be fully rotated out of the said handle 1.

Another variation of a conventional folding knife is represented by the U.S. patent "Opening and Closing Assising Mechanism for Folding Knife" (U.S. Pat. No. 6,145,202). Referring to FIG. 2, it consists of a handle 3, a blade 4 pivotably conjoined to the front end of the said handle 3 and capable of being rotated into the said handle 3, an arcuate limiting slot 30 adjacent to the pivotable conjoinment position between the said handle 3 and blade 4 having a curved orientation identical to the rotational orientation of the said blade 4, a slide slot 32 situated in the rear end of the said handle 3 away from the pivotable conjoinment position of the said blade 4, and a spring 34, with one extremity of the spring 34 movable inserted into the said slide slot 32 and its other extremity inserted through the said limiting slot 30 as well as fixed into a hole in the said blade 4.

Based on the preceding elaboration and referencing FIG. 2, in the said U.S. patent, the said spring 34 has one extremity capable of moving in the said slide slot 32 and an another extremity secured onto the said blade 4 such that as the blade 4 is rotated into the said handle 3, the said spring 34 flexes and its opposite extremity moves from point A along the said limiting slot 30 such that when the said spring 34 passes point B of the said limiting slot 30, the elasticity of the said spring 34 causes the said spring 34 to converge at one end of the said slide slot 32 and move away from the pivotable conjoinment position of the said blade 4 and handle 3 inside the said slide slot 32, thereby completing the full rotation of the said blade 4 into the handle 3, with the full rotation of the said blade 4 out of the said handle 3 achieved by reversing the said procedure.

However, in each of the said two conventional folding knives, since the blade, the handle, and the spring must be assembled together and, therefore, match each other, the fabrication of such matched components involve a troublesome and complex production process; for example, the fabrication of the said blade includes matching the spring to the limiting slot and the slide slot.

Additionally, in terms of production-line assembly, the assembly procedures of the said folding knives are too complicated; for example, the opposing extremities of the said spring have to be inserted through the said limiting slot 30 and fixed to the said hole, while the said guide wheel must be installed onto the said blade.

Furthermore, in terms of utilization, the leverage length of the said spring is excessively long such that the said blade is difficult to be folded into the said handle or rotated out of the said handle automatically.

SUMMARY OF THE INVENTION

In view of the numerous fabrication, assembly, and utilization inconveniences and difficulties of the conventional folding knives and the need to improve their shortcomings, the inventor of the invention herein conducted long-term research and experimentation that culminated in the successful research, development, and design of the foldable knife structure of the invention herein that comprises of a handle; a blade pivotably conjoined to a position adjacent to one end of the said handle; a set block adjacent to the pivotable conjoinment position of the said blade and handle, with the said set block having a detent notch; a spring situated at the other end of the said handle, with the opposite extremity of the said spring extending to a position on the said set block. When the said blade is folded into the said handle, the said spring is against the circumferential edge of the said set block, causing the said set block to produce torsion that rotates the said blade into a receiving slot. When the said blade is extended from the said receiving slot, the said spring impels the said set block to produce torsion that rotates the said blade out of the said receiving slot, causing the said blade to automatically bound out of the said receiving slot.

The objective of the invention herein is to provide a foldable knife structure, wherein when the said spring is not in a flexured state, the center portion of the said spring is against one side of the said receiving slot inside the said handle and when the said blade is folded inside the said receiving slot, the leverage length of the said spring is shorter such that a greater functional force and tension is exerted by the spring against the said set block which are utilized to firmly maintain the said blade in a folded state within the said receiving slot or to enable the rapid extension of the said blade from the receiving slot.

DETAILED DESCRIPTION OF THE INVENTION

Figure 1:
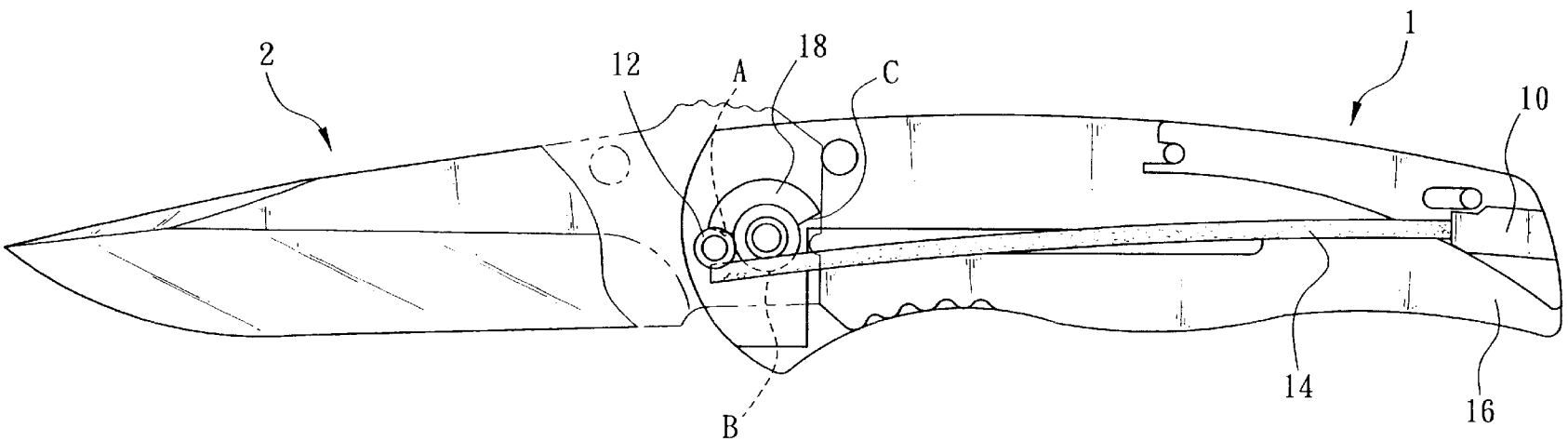
FIG. 1 (Prior Art)
FIG. 1 is a cross-sectional drawing of a conventional folding knife.
Figure 2:
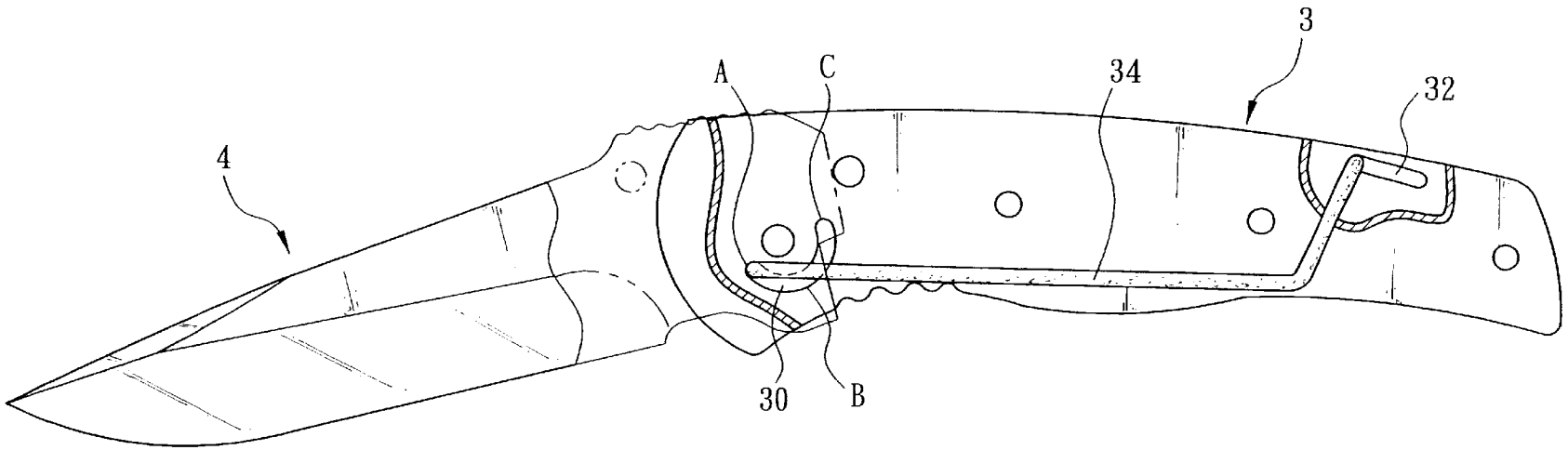
FIG. 2 (Prior Art)
FIG. 2 is a cross-sectional drawing of another conventional folding knife.

Referring to FIG. 3, FIG. 4, FIG. 5, and FIG. 12, the foldable knife structure of the invention herein comprises of a handle 5; a receiving slot 51 formed in one side of the handle 5; a blade 6 pivotably conjoined to a position adjacent to one end of the said handle 5 such that the said blade 6 is capable of being rotated around the point of pivotable conjoinment and folded into the said receiving slot 51 or drawn out from the said receiving slot 51 and extended outside the said receiving slot 51; a set block 7 situated at one side of the said blade 6 adjacent to the pivotable conjoinment position of the said handle 5, with the said set block 7 having a detent notch 70 in the circumferential edge at the confluence of its maximum outer diameter and minimum outer diameter such that when the said blade 6 is drawn out and extended from the said receiving slot 51, the said detent notch 70 faces the end of the said receiving slot 51; and a spring 8 inside the said receiving slot 51 that is situated at the other end of the said handle 5, with the opposite extremity of the said spring 8 extending to a position on the said set block 7.

Figure 4:
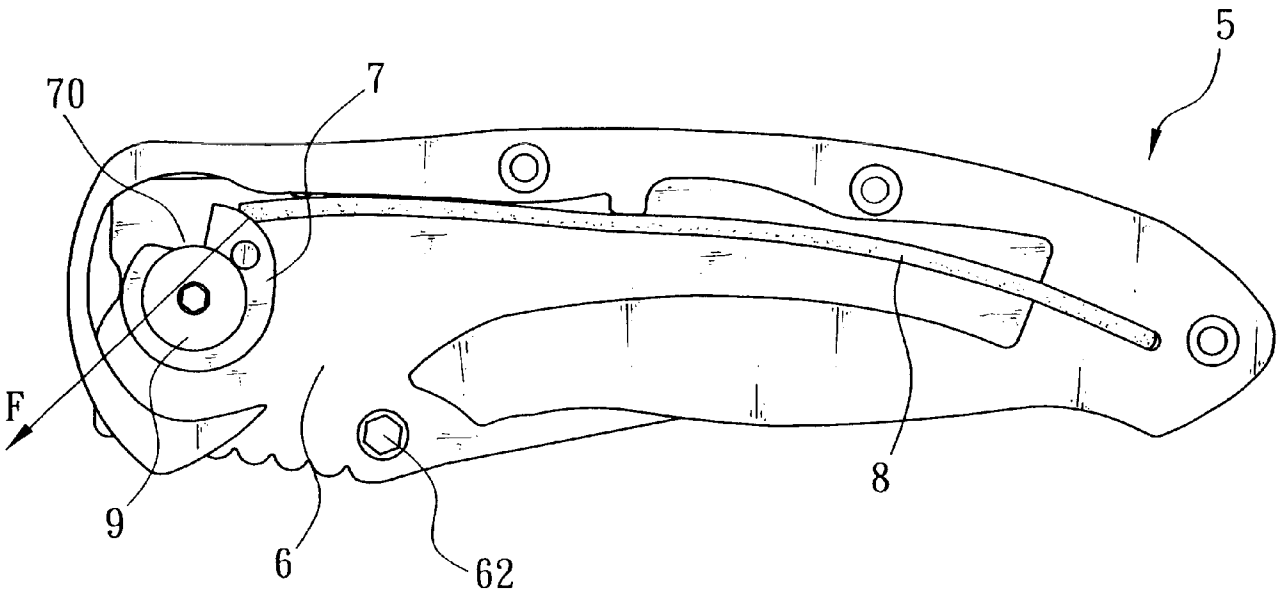
FIG. 4 is a cross-sectional drawing of the invention herein with the blade folded inside the receiving slot.

Referring to FIG. 6, FIG. 7, FIG. 8, FIG. 9, FIG. 10, FIG. 11 and FIG. 12 as well as FIG. 4, when the said blade 6 is folded inside the said receiving slot 51, the said spring 8 is postured against the said detent notch 70 at the maximum outer diameter, circumferential edge of the said set block 7 such that the said spring 8 is flexed and produces a functional force F, with the said functional force F applied in the direction of the said set block 7 and enabling the said set block 7 to transfer torsion that rotates the said blade 6 towards the interior of the receiving slot 51.

Figure 5:
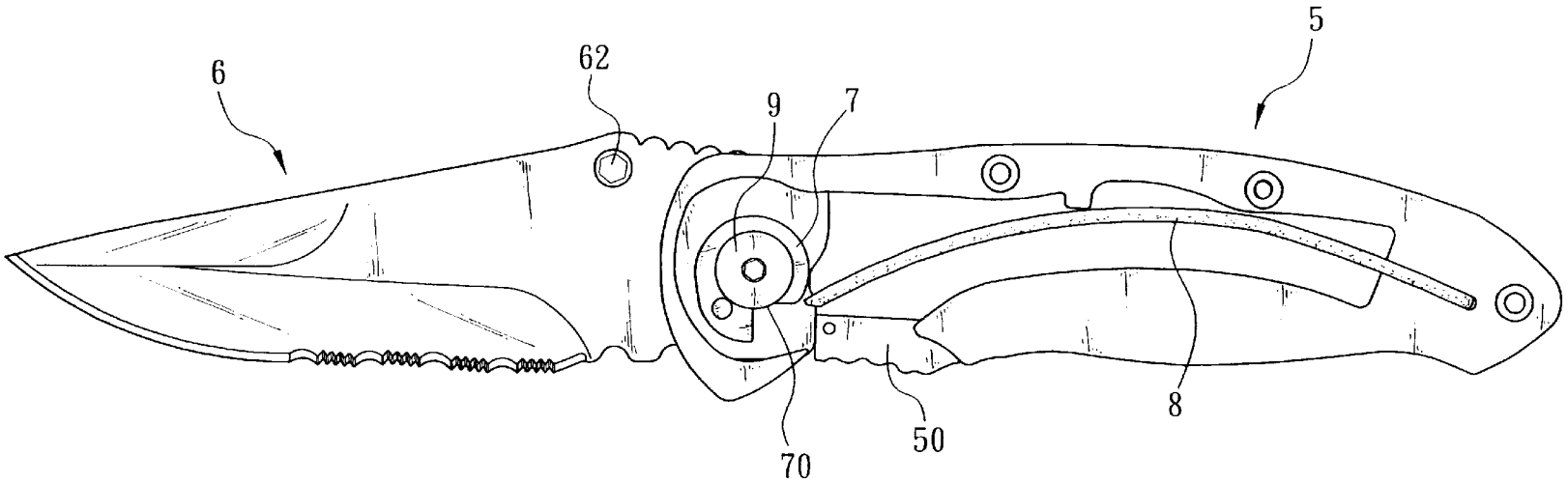
FIG. 5 is a cross-sectional drawing of the invention herein with the blade extended outside the receiving slot.
Figure 6:
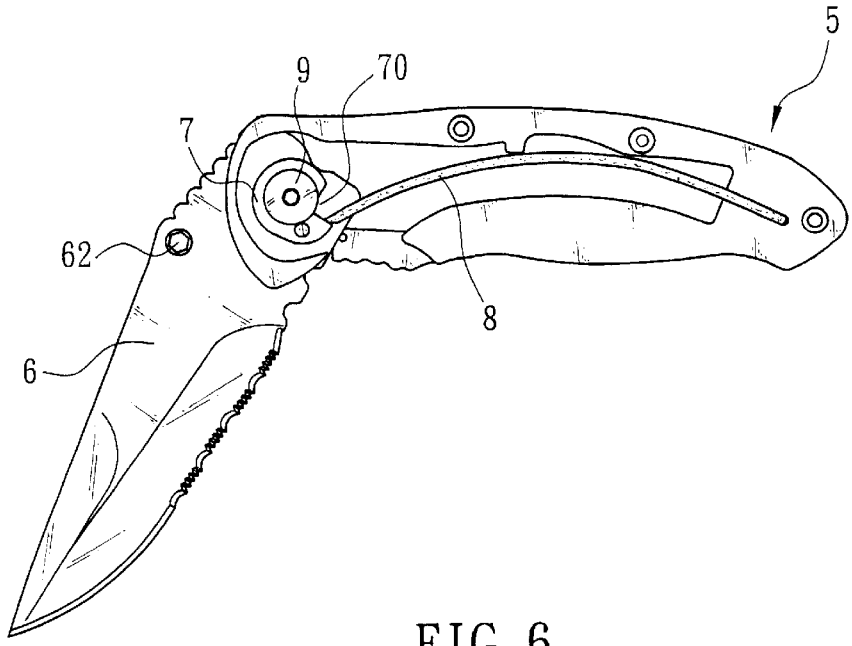
FIG. 6 is a cross-sectional drawing of the invention herein that illustrates its operation (1).
Figure 7:
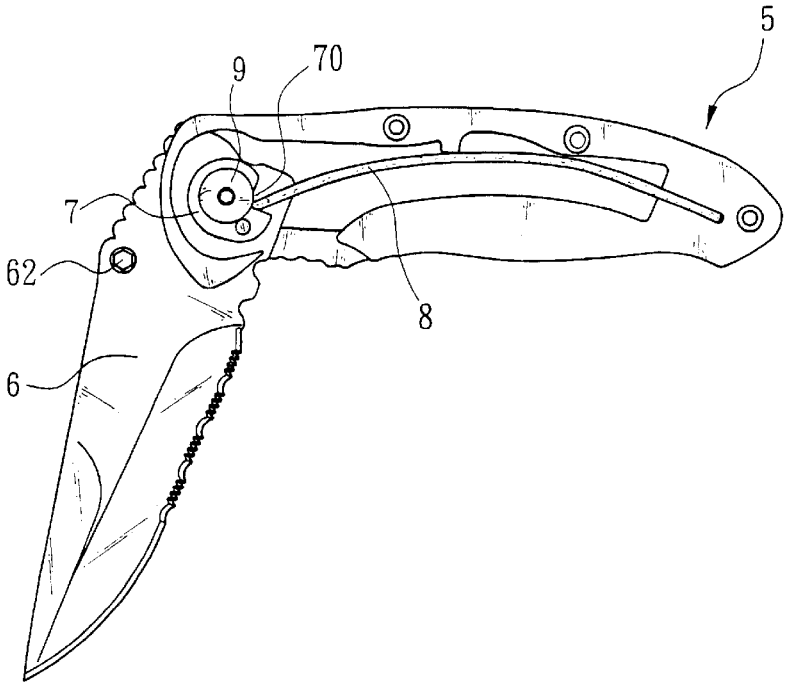
FIG. 7 is a cross-sectional drawing of the invention herein that illustrates its operation (2).
Figure 8:
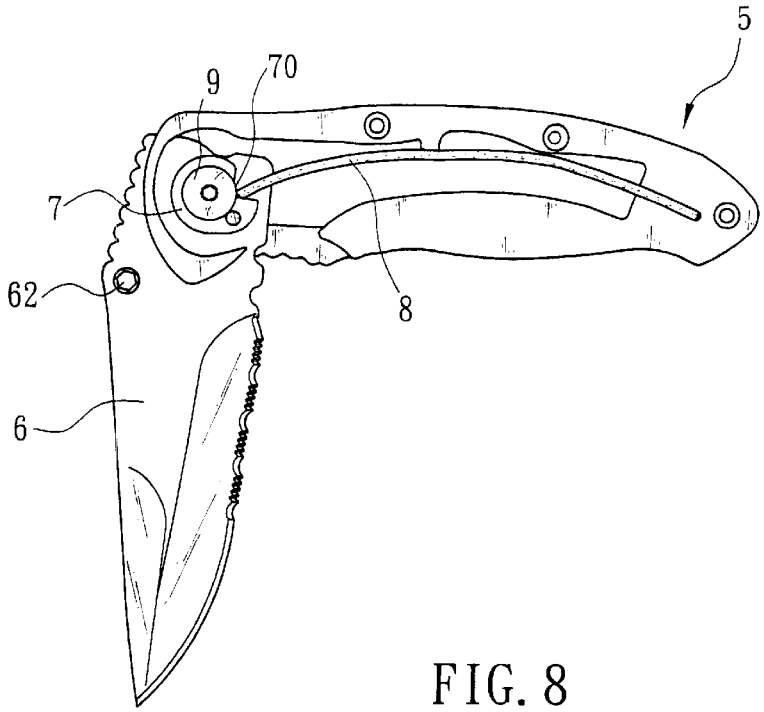
FIG. 8 is a cross-sectional drawing of the invention herein that illustrates its operation (3).
Figure 9:
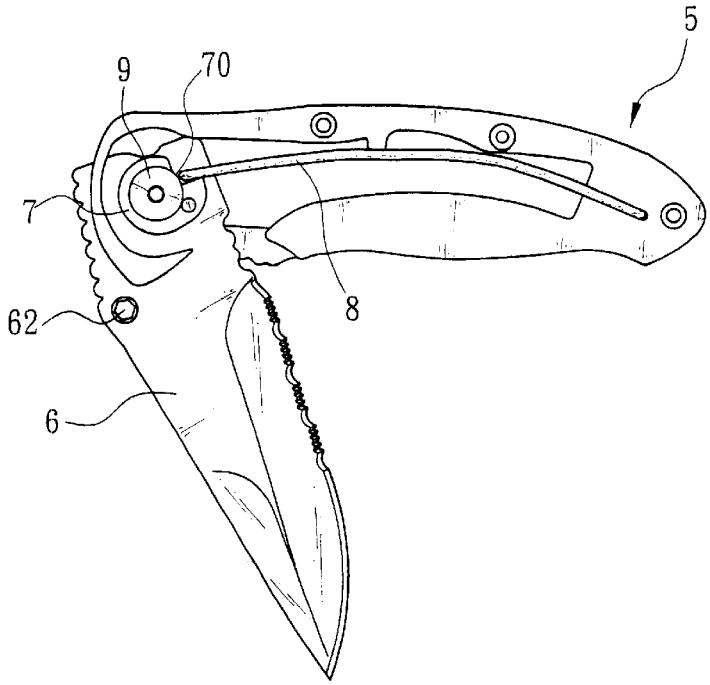
FIG. 9 is a cross-sectional drawing of the invention herein that illustrates its operation (4).
Figure 10:
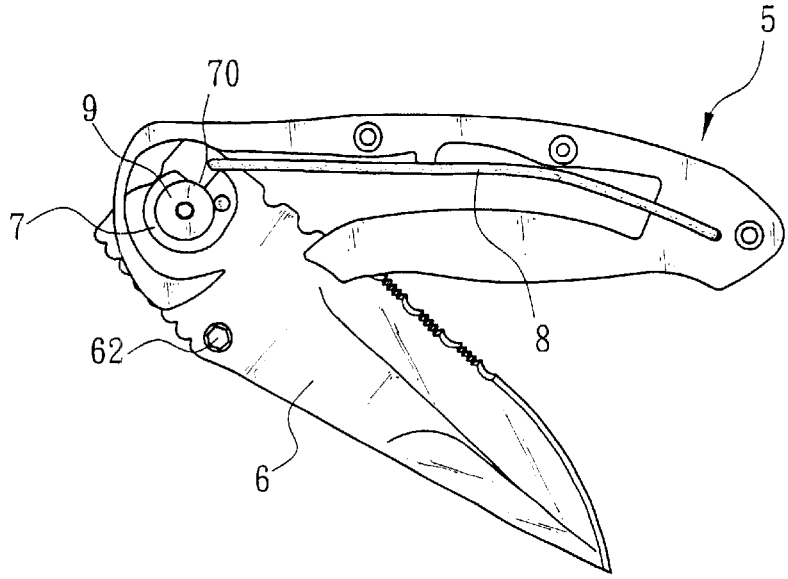
FIG. 10 is a cross-sectional drawing of the invention herein that illustrates its operation (5).
Figure 11:
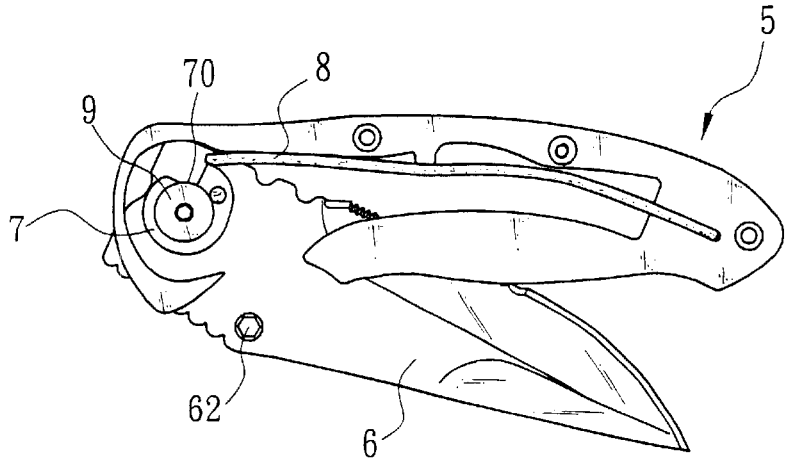
FIG. 11 is a cross-sectional drawing of the invention herein that illustrates its operation (6).
Figure 12:
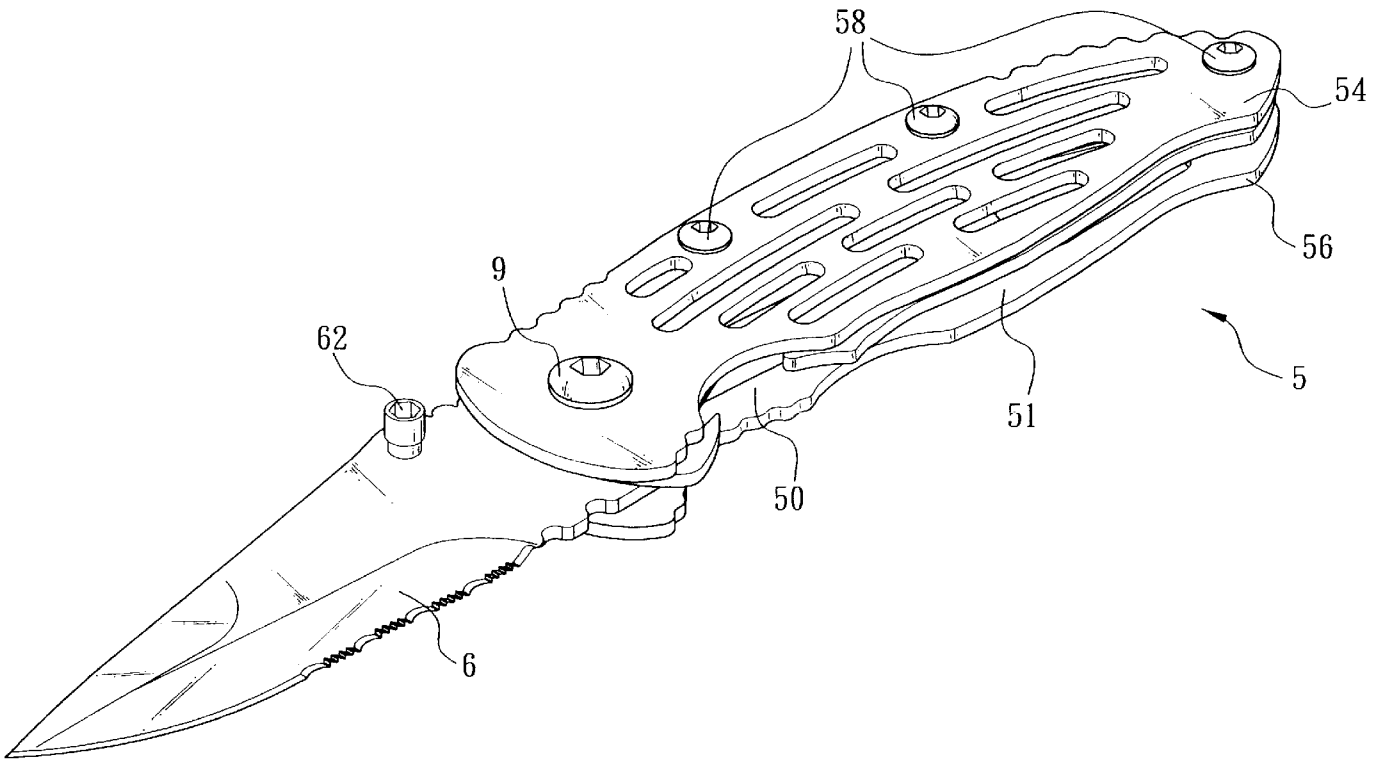
FIG. 12 is an isometric drawing of the invention herein.

During the process of drawing the said blade 6 out of the said receiving slot 51, the operational sequences of which that occur between the said spring 8 and the set block 7 are shown in FIG. 11 and FIG. 10 to FIG. 5 respectively, the said blade 6 is drawn out of the receiving slot 51, when the opposite extremity of the said spring 8 is against the maximum outer diameter, circumferential edge of the said set block 7, the torsion produced causes the said set block 7 to rotate the said blade 6 towards the exterior of the said receiving slot 51 and subjects the said blade 6 to the functional force of the spring 8 such that it automatically bounds out of the said receiving slot 51.

Figure 3:
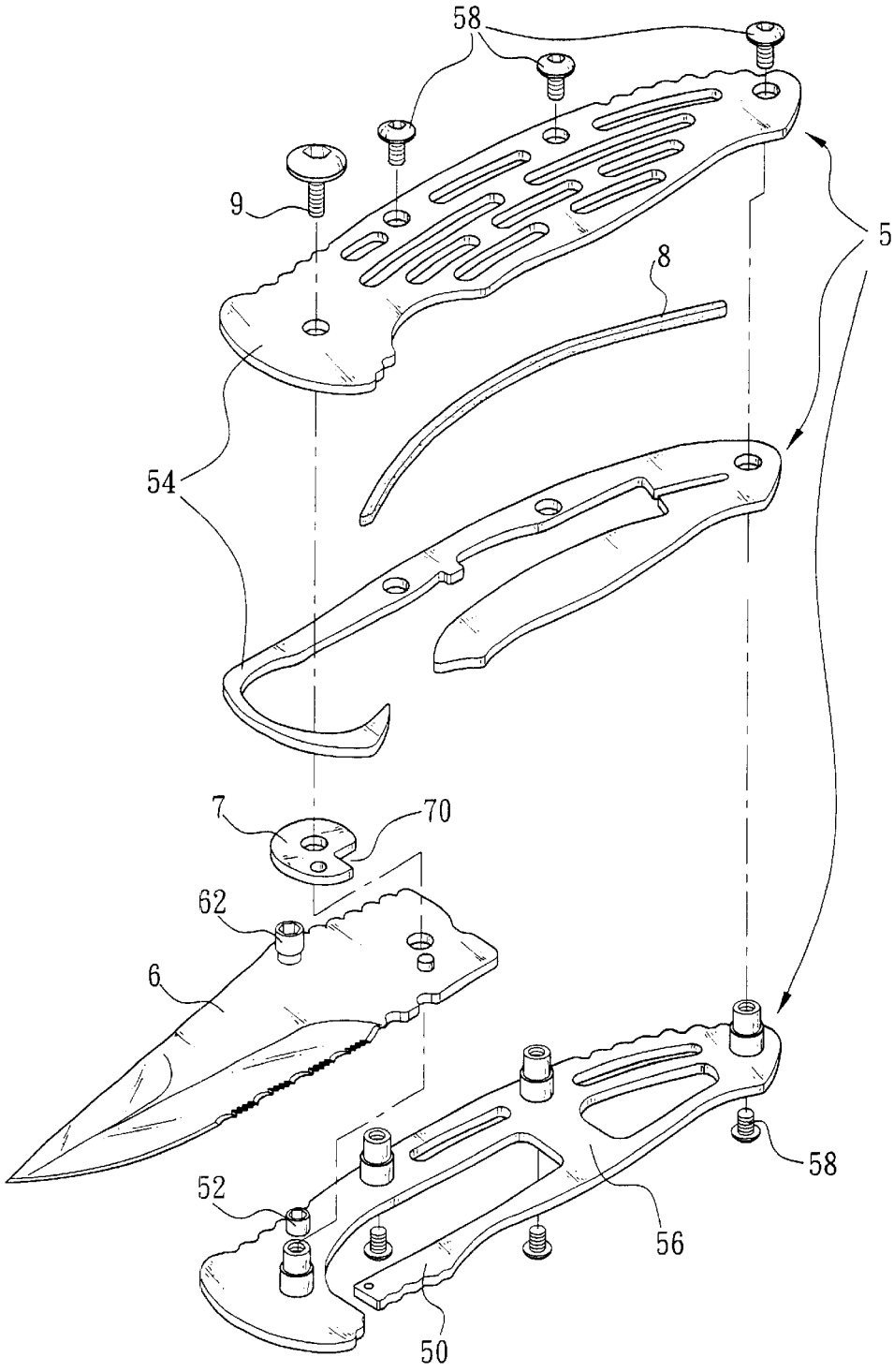
FIG. 3 is an exploded drawing of the invention herein.

In the most preferred embodiment of the invention herein, referring to FIG. 3 and FIG. 4, before the said spring 8 is in a flexured state, the said spring 8 is curved with the center portion is bowed away from its two ends and, furthermore, the contour of the center portion closely resembles that of the said receiving slot 51 such that when the said blade 6 is folded into the said receiving slot 51, this increases the curvature of the said spring 8 and enables it to produce a greater functional force F and tension.

When the said blade 6 is being folded inside the said receiving slot 51, one side of the spring 8 inside the said handle 5 is moving against the interior side of the said receiving slot 51 opposite to the said side of the spring 8, it reveals that the contour of the said spring 8 is quite similar to that of the spring 8 not yet against the said side during the process. However, when the said spring 8 is brought against the said side, the fulcrum (i.e., the center point of the spring 8 against the said side) produced by the flexture of the said spring 8 is closer to the point where the said blade 6 is pivotably conjoined to the said handle 5; in other words, the leverage length of the said spring 8 is shorter than that not yet against the said side, wherein the fulcrum produced by the flexure of the said spring 8 is farther away from the point where the said blade 6 is pivotably conjoined to the said handle 5 such that the leverage length of the said spring 8 is longer, at which time a proportionately equivalent flexure is produced in the said spring 8; as such, if the leverage length is shorter, the external force additionally exerted at the spring 8 is more than that exerted when its lever length is longer; in other words, when the leverage length of the said spring 8 is shorter, the said spring 8 exerts a greater functional force F and tension against the said set block 7.

Based on the preceding section, in the said embodiment, if the said spring 8 is not in the flexured state, the center portion of the said spring 8 is against one side of the said receiving slot 51 inside the said handle 5 and when the said blade 6 is folded inside the said receiving slot 51, the leverage length of the said spring 8 is shorter such that a greater functional force F and tension is exerted by the spring 8 against the said set block 7 which are utilized to firmly maintain the said blade 6 in a folded state within the said receiving slot 51 or to enable the rapid extension of the said blade 6 from the receiving slot 51; furthermore, when the said blade 6 is folded into the said receiving slot 51 (as shown in FIG. 4), the said spring 8 is postured against one side of the said receiving slot 51 near the point of pivotable conjoinment between the said blade 6 and handle 5, enabling the said spring 8 to exert a greater functional force F and tension against the said set block 7.

In another most preferred embodiment of the invention herein, referring to FIG. 3, a locking component 50 is disposed inside the said receiving slot 51; the said locking component 50 possesses elasticity and, furthermore, is oriented towards the center contour of the said receiving slot 51 such that when the said blade 6 is extended from the said receiving slot 51, the said locking component 50 is postured against a side at the end of the said blade 6 nearest to the point of pivotable conjoinment, with the said blade 6 thereby locked in place by the said locking component 50 to the extent that it cannot be rotated back into the said receiving slot 51 and, furthermore, in the said embodiment, a limiting component 52 is disposed within the said receiving slot 51 such that when the said blade 6 is extended from the said receiving slot 51, the limiting component 52 is situated against another side at the end of the said blade 6 nearest to the point of pivotable conjoinment, with the said blade 6 kept stationary by the said limiting component 52 to the extent that it cannot be further rotated.

In the said embodiment, the said handle 5 consists of a mutually assembled upper shell 54 and a lower shell 56 and a plurality of fastening components 58 that fasten the said upper and lower shells 54 and 56 together, thereby forming the said receiving slot 51; the said set block 7 is secured onto the said blade 6 such that the said set block 7 and the said blade 6 become a single structural entity, enabling the said blade 6 and the said set block 7 to be conjoined at one end of the said handle 5 by utilizing a pivot shaft 9, thereby allowing the said blade 6 and set block 7 to rotate around the said pivot shaft 9 as they are drawn out of the said receiving slot 51 or folded into the said receiving slot 51.

In the said embodiment, a toggling rod 62 is disposed on the exposed portion of the blade 6 when the said blade 6 is in a folded state within the said receiving slot 51 and, as such, when the said blade 6 is folded inside the said receiving slot 51, pressing the said toggling rod 62 results in the rotation of the said blade 6 because the opposite extremity of the said spring 8 is against the maximum outer diameter, circumferential edge of the said set block 7 and the torsion produced causes the said set block 7 to rotate the said blade 6 towards the exterior of the said receiving slot 51.

A comparison of the foldable knife of the invention herein with the conventional folding knives conveys that the leverage length of the spring 8 of the present invention is considerably shorter than leverage length of the prior art spring, enabling the blade 6 of the invention herein to be extended from or rotated into the receiving slot 51 with greater rapidity than the prior art blade and, furthermore, the component assembly and fabrication of the said foldable knife is simpler and faster than that for the components of the conventional folding knives; for example, as the spring 8 of the invention herein is inserted into the receiving slot 51, the method allows for the simultaneous fastening of the said handle 5 as well as the coordinated installation of the said set block 7, whereas the conventional folding knife requires a matched spring, lock block, and guide wheel, wherein one extremity of the spring is fitted into the said slide slot and the opposite extremity is inserted into said limiting slot and then secured to the through-hole formed in the said blade, a procedure that is completely different.

Furthermore, in the rotation process of the conventional folding knife, one end of the conventional folding knife spring necessarily exceeds the point of pivotable conjoinment between the said blade and handle, whereas the spring 8 of the invention herein does not extend beyond the point of pivotable conjoinment between the said blade 6 and handle 5 during the rotation process and, therefore, further differs from the structure of the conventional folding knives.

While the invention has been described by means of specific embodiments, numerous modifications and variations could be made thereto by those skilled in the art without departing from the scope and spirit of the invention set forth in the claims.

What is claimed is:

1. A foldable knife structure comprised of:

a handle, with the said handle having a receiving slot formed therein;

a blade pivotably conjoined to a position adjacent to one end of the said handle such that the said blade is capable of being rotated around the position of pivotable conjoinment and folded into the said receiving slot or drawn out from the said receiving slot and extended outside the said handle;

a set block situated at one side of the said blade adjacent to the pivotable conjoinment position of the said handle, with the said set block having a detent notch in the circumferential edge at the confluence of its maximum outer diameter and minimum outer diameter such that when the said blade is drawn out of and extended from the said receiving slot, the said detent notch faces the opposing end of the said receiving slot;

a spring having one end inside the said receiving slot and situated near the other end of the said handle, with the opposite extremity of the said spring extending to a position on the said set block such that when the said blade is folded inside the said receiving slot, the opposite extremity of the said spring is against the maximum outer diameter, and the torsion produced causes the said set block to rotate the said blade towards the interior of the said receiving slot, and during the process of drawing the said blade out of the said receiving slot, the torsion produced causes the said set block to rotate the said blade towards the exterior of the said receiving slot and subjects the said blade to the functional force of the said spring such that it automatically bounds out of the said receiving slot.

2. The foldable knife structure as mentioned in claim 1, wherein the said spring is of a curved shape before the said spring is in the flexured state, and the distance between two extremities of the said spring and the ends of the said receiving slot is shorter than the distance between center portion of the said spring and the ends of the said receiving slot.

3. The foldable knife structure as mentioned in claim 1, wherein center portion of the said spring is against one side of the said receiving slot inside the said handle while the said spring is not in the flexured state.

4. The foldable knife structure as mentioned in claim 1, wherein the said foldable knife structure further comprises a locking component internally disposed in the said receiving slot; the said locking component possesses elasticity and is oriented towards the center contour of the said receiving slot such that when the said blade is extended from the said receiving slot, the said locking component is postured against the end of the said blade nearest to the position of pivotable conjoinment, with the said blade thereby locked in place by the said locking component to the extent that the said blade cannot be rotated back into the said receiving slot.

5. The foldable knife structure as mentioned in claim 1, wherein the said foldable knife structure further comprises a limiting component internally disposed in the said receiving slot; such that when the said blade is extended from the said receiving slot, the said limiting component is situated against another side at the end of the said blade nearest to the position of pivotable conjoinment, with the said blade kept stationary by the said limiting component to the extent that it cannot be further rotated.

6. The foldable knife structure as mentioned in claim 1, wherein the said handle consists of a mutually assembled upper shell and a lower shell and a plurality of fastening components that fasten the said upper and lower shells together, thereby forming the said receiving slot.

7. The foldable knife structure as mentioned in claim 1, wherein the said set block is secured onto the said blade, enabling the said blade and the said set block being conjoined at one end of the said handle by utilizing a pivot shaft and thereby allowing the said blade and the said set block to rotate around the said pivot shaft as being drawn out of the said receiving slot or folded into the said receiving slot.

8. The foldable knife structure as mentioned in claim 1, wherein the said set block and the said blade are made into a single structural entity, and are conjoined at one end of the said handle by utilizing a pivot shaft, thereby allowing the said blade and the said set block to rotate around the said pivot shaft as being drawn out of the said receiving slot or folded into the said receiving slot.

9. The foldable knife structure as mentioned in claim 1, wherein a toggling rod is disposed on the exposed portion of the said blade when the said blade is in a folded state within the said receiving slot such that when the said blade is folded in the said receiving slot, pressing the said toggling rod results in the rotation of the said blade.

* * * * *